United States Patent [19]

Johnson

[11] Patent Number: 4,815,499

[45] Date of Patent: Mar. 28, 1989

[54] COMPOSITE FORMING FABRIC

[75] Inventor: Dale B. Johnson, Ottawa, Canada

[73] Assignee: JWI Ltd., Ontario, Canada

[21] Appl. No.: 163,161

[22] Filed: Feb. 25, 1988

[51] Int. Cl.[4] ..... D03D 15/00

[52] U.S. Cl. ..... 139/383 A; 139/410; 139/414; 162/DIG. 1

[58] Field of Search ..... 139/383 A, 425 A, 408, 139/409, 410, 413, 414; 162/348, DIG. 1; 428/223, 225, 257

[56] References Cited

U.S. PATENT DOCUMENTS 3,885,603 5/1975 Slaughter ..... 139/425 A
4,356,844 11/1982 Thompson ..... 139/383 A
4,705,601 11/1987 Chiu ..... 139/383 A

FOREIGN PATENT DOCUMENTS 2157328 10/1985 United Kingdom ..... 139/383 A

*Primary Examiner*—Henry S. Jaudon
*Attorney, Agent, or Firm*—Oblon, Fisher, Spivak, McClelland & Maier

[57] ABSTRACT

A composite paper making fabric comprising at least two complete weaves each formed by its own set of warp and weft yarns and interconnected by a binder yarn which is interwoven with the two complete weaves. An upper one of the complete weaves constitutes a paper-side weave which is comprised of flattened warp yarns interwoven with its weft yarns.

10 Claims, 4 Drawing Sheets

FIG. 3B
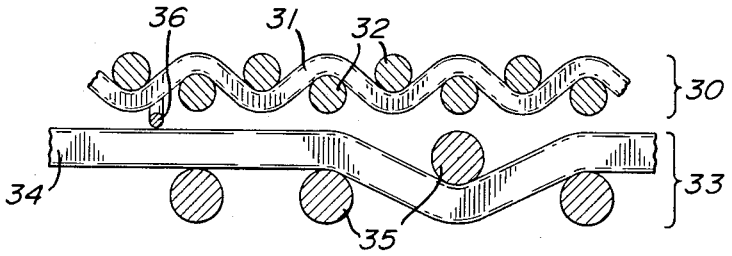
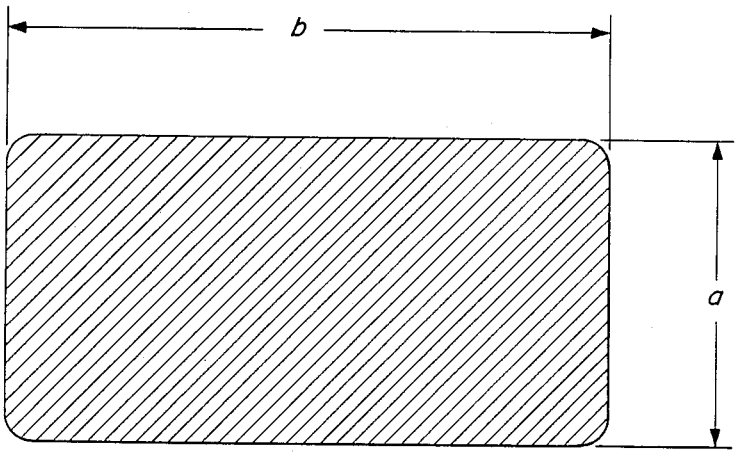
FIG. 4

COMPOSITE FORMING FABRIC

This application is a continuation of application Ser. No. 06/935,953 filed on Nov. 28, 1986, now abandoned.

BACKGROUND OF INVENTION

1. Field of Invention

The present invention relates to paper machine forming fabrics and is particularly directed to a composite fabric comprised of at least two complete weaves, each having its own set of warp and weft yarns, with a warp or weft binder yarn that interconnects the two layers. The upper weave, that is the paper-side weave, is provided with flattened warp yarns.

In the continuous manufacture of paper, the paper machine is comprised essentially of a forming section, a press section, and a dryer section. In the forming section a dilute slurry of fibers and fillers is directed onto the surface of a moving forming fabric by means of a head box. As the forming fabric moves along the forming section, water is removed from the slurry by gravity and various dewatering devices. By the end of the forming section a continuous wet but self-supporting web of fibers and fillers remains on the surface of the forming fabric. The web then passes out of the forming section into the press section where more water is removed by mechanical pressing, after which the web passes into the dryer section where the remaining water is removed by an evaporative process.

2. Description of prior art

In recent years forming fabrics have been woven of plastic polymeric filaments in single-layer twill patterns and, although improvements have been made to produce reasonably satisfactory single-layer fabrics, the more recent development of multi-layer forming fabrics has given additional benefits to paper makers by providing increased fiber retention and fabric stability.

Typically, the paper side or upper layer of a composite forming fabric of the prior art is a fine mesh plain weave, which provides excellent retention of fibers, good dewatering, and a minimum of mark in the paper produced on its surface. The running side, or bottom layer, of such a composite fabric is usually a coarser mesh, with larger diameter strands than those of the upper layer, in order to provide resistance to stretching, narrowing, and wear.

The two layers of a composite fabric are typically interconnected in one of two ways. The first and most common method is to use a weft binder, which is usually a finer diameter yarn than those of the two layers, and is woven so as to interweave the top and bottom warp yarns and thus bind the two layers together. The other method is to interweave the warp yarns of the top layer with the weft yarns of the bottom layer, so as to bind the two layers together.

Composite forming fabrics having this description and with various binder yarn configurations are well known, examples of which are described in Canadian Pat. No. 1,115,177 and U.S. Pat. No. 4,501,303.

The importance of fabric surface geometry and, in particular, the size of the surface openings (frames) defined by the strands in the top layer, is described in the inventor's paper "Retention and Drainage of Multilayer Fabrics" (Pulp & Paper Canada, May 1986). For optimum fiber retention, it is advantageous to make these openings, particularly their machine direction lengths, as small as possible. In addition, it is often desirable to make the openings in the fabric small so that the dewatering capacity of the fabric is reduced, and thus more controlled.

One of the problems suffered by paper machine screens made as composite fabrics is that the plain weave construction of their upper layer, by the very nature of the weave geometry, imposes severe restrictions on the degree to which the size of openings in the fabric can be reduced.

Another problem suffered by composite fabrics in some applications arises from their greater thickness, which increases the void volume, resulting in higher volumes of water being carried by the fabric. On some paper machines, the greater thickness of the composite fabric results in unacceptable defects in the formation of the paper web.

A further problem suffered by composite fabrics is that the warp or weft binder yarns distort the upper paper-makaing surface, typically creating a localized surface depression often referred to as a "dimple". If the "dimple" is too deep, or results in blockage of some of the openings in the top layer, an unacceptable wire mark may be produced in the paper sheet formed on the top layer.

SUMMARY OF INVENTION

An important feature of the present invention is to overcome the above-mentioned problems by providing a composite fabric which has substantially smaller surface openings in the upper or paper-side layer by using monofilament warp strands with a flattened profile (cross-section).

Another feature of the present invention is to provide a composite fabric of reduced thickness.

Yet another feature of the present invention is to reduce the severity of the "dimples" in the upper layer created by the warp or weft binder yarns that are used to join the two layers of the composite fabric.

The use of flattened, high molecular weight, polyester warp strands in multi-layer fabrics has been described in U.K. published patent application No. 2,157,328A. In this case, however, the objectives of using flattened warp strands were to improve wear resistance and to reduce the thickness and hence the void volume of the fabric. In addition, importantly, that invention applied specifically to those double-layer fabrics in which there is only one set of warp yarns.

According to the above features, from a broad aspect, the present invention provides a composite paper making fabric comprising at least two complete weaves, each formed by its own set of warp and weft yarns and interconnected by binder yarns which are interwoven with the two complete weaves. The upper weave constitutes a paper-side layer which is comprised of flattened warp yarns interwoven with its weft yarns.

Usually, the bottom weave strands are larger and are woven in a coarser mesh count than the upper weave, although the bottom weave may also be woven with the same size of flattened warps and same mesh count as the upper weave.

BRIEF DESCRIPTION OF DRAWINGS

A preferred embodiment of the present invention will now be described with reference to an example thereof as illustrated in the accompanying drawings, in which:

FIGS. 3A and 3B are sectional views, similar to FIGS. 2A and 2B, but illustrating a modified lower weave with flattened warps; and FIG. 4 is an enlarged cross-section of one of the flattened warp yarns.

DESCRIPTION OF PREFERRED EMBODIMENTS

Figure 1:
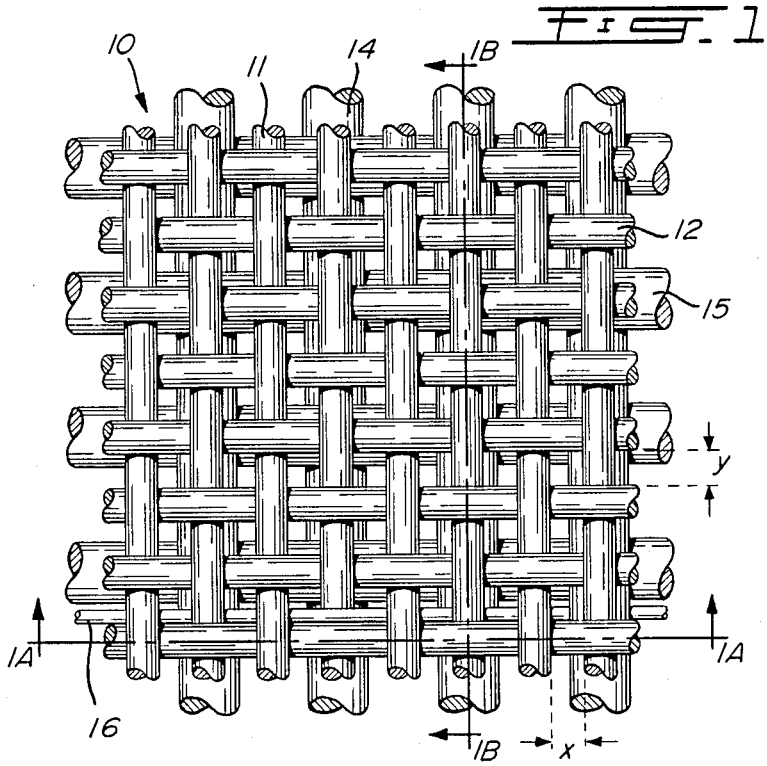
FIG. 1 is a plan view of the upper layer of a composite fabric of the prior art.

Referring now to the drawings, FIG. 1 depicts, in plan view, the upper layer 10 of a composite fabric of the prior art, in which all of the strands 11 and 12 have a round cross-section. In this upper layer, warp strands 11 and weft strands 12 are interwoven in a plain weave construction.

Figure 1A:
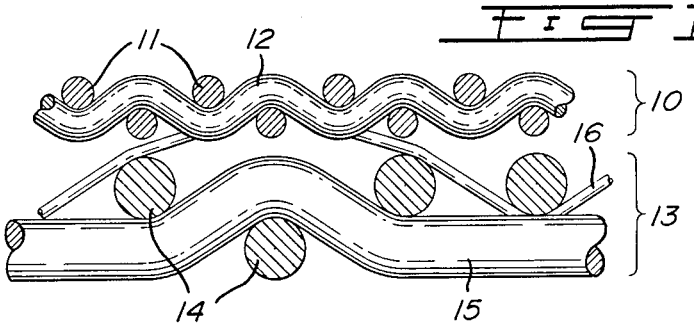
FIGURES 1A and 1B are sectional views of the composite fabric along lines A—A and B—B respectively.
Figure 1B:
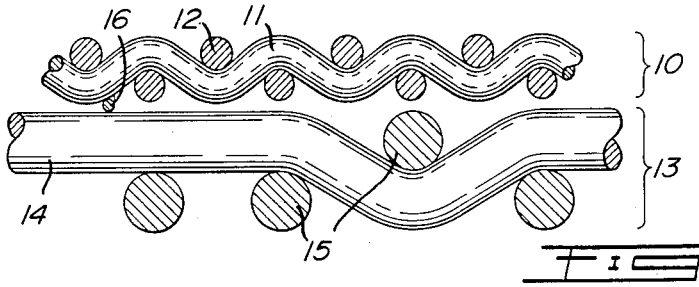

FIGS. 1A and 1B illustrate the composite nature of the fabric comprising an upper layer 10 of warps 11 and wefts 12 in plain weave construction and a lower layer 13 having a four-harness satin weave with coarser warps 14 and wefts 15 and with half the mesh count of the upper layer. The two layers are tied together in the weft direction by a binder yarn 16. The cross-machine direction width of the surface openings (frames) in the upper layer 10 is illustrated by dimension "x" and the machine direction length of the frames is shown by dimension "y".

Figure 2:
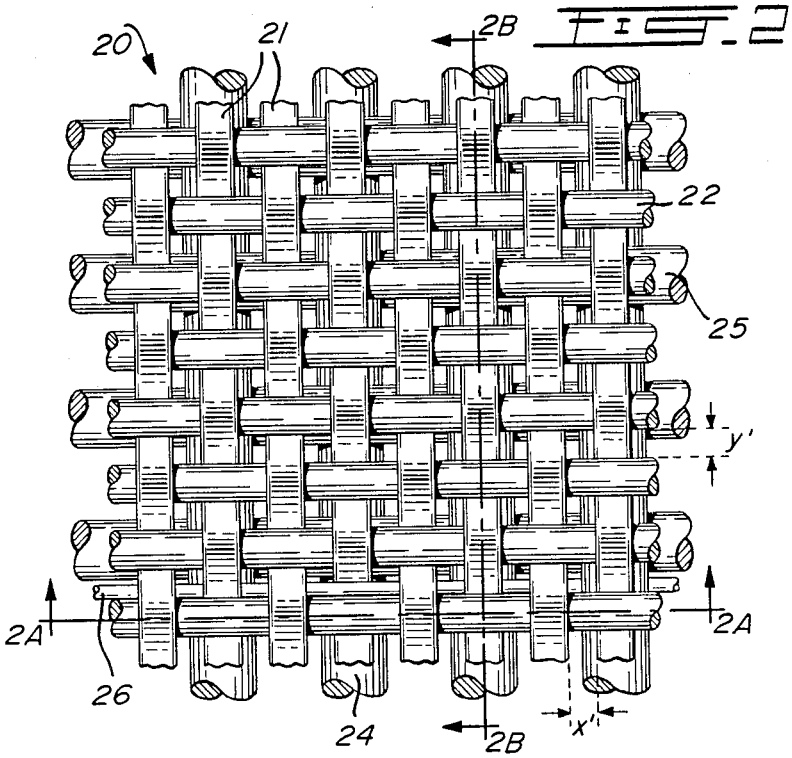
FIG. 2 is a plan view of the upper layer of a composite fabric of the invention in which the warp yarns of the upper layer have a flattened profile.
Figure 2A:
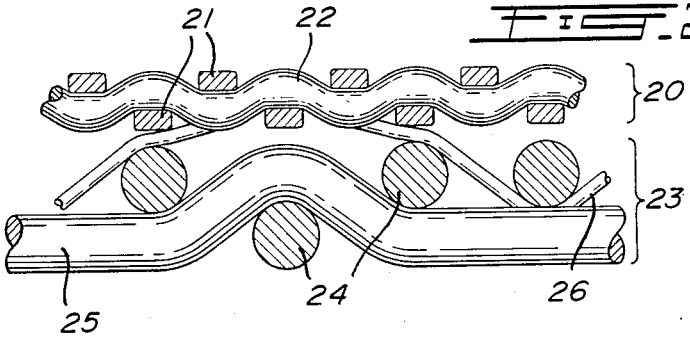
FIGS. 2A and 2B are sectional views along lines A—A and B—B respectively.
Figure 2B:
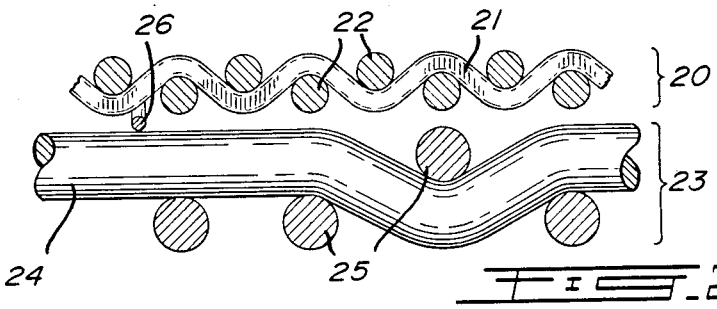

FIG. 2 is a plan view of the upper layer 20 of a composite fabric constructed in accordance with the present invention, and having the same test count as the fabric in FIG. 1. However, with our invention the warp yarns 21 of the upper plain weave layer have a flattened profile and the weft yarns 22 are of a larger diameter. The shape of the flattened warps 21 is shown in the sectional view of FIG. 2A and, in greatly enlarged cross-section, in FIG. 4. The lower layer 23 is a four-harness satin weave with coarse warps 24 and wefts 25, with half the mesh count of the upper layer 20. The two layers are tied together in the weft direction by a binder yarn 26. The cross-machine direction width dimension of the frames "$x^1$" has been reduced due to the use of the flattered warp strands 21 which are wider than the round strands 11 of FIG. 1. A reduction in the machine direction dimension "$y^1$" of the frames has been achieved by the use of larger diameter weft strands 22. Flattened warp makes possible the use of either larger diameter weft at the same weft count or, alternately, unchanged weft diameter at a higher weft count. Either combination achieves the same result of a reduced machine direction frame length. A plain weave upper layer with a warp count of 63 strands per inch has been woven with flattened warps having dimensions of 0.0045"×0.0075" that is, an aspect ratio of 1.67. This enabled 0.0078" weft to be woven at a weft count of 74 strands per inch, whereas with round warp of 0.007" diameter at the same warp count (63 strands per inch) it was not possible to use a weft size larger than 0.0072" at a weft count of 74 strands per inch. A similar result was achieved in the same plain weave upper layer at the same warp count (63 strands per inch) with flattened warps having dimensions of 0.0044"×0.0077", that is, an aspect ratio of 1.75.

Figure 3:
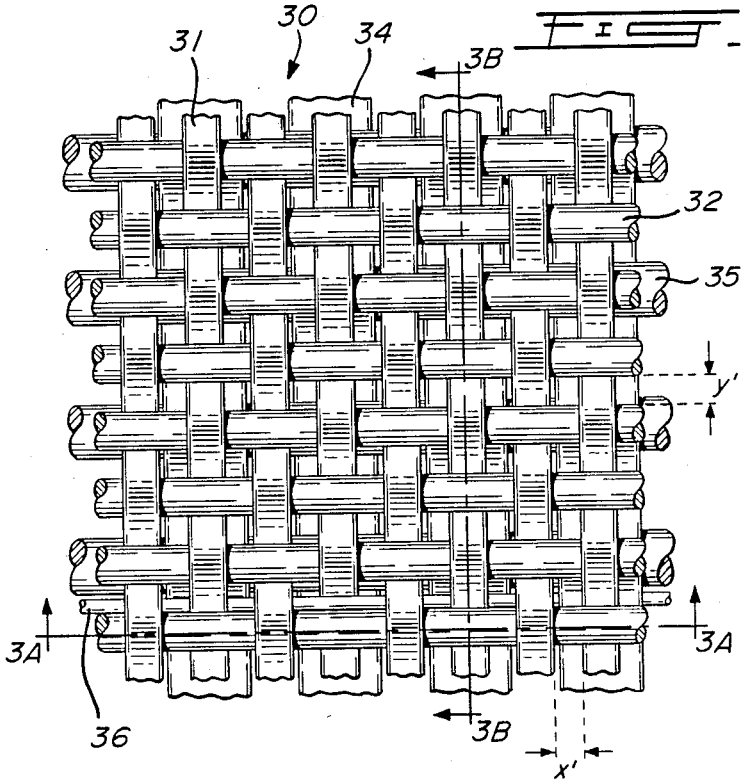
FIG. 3 is a plan view of the upper layer of a composite fabric of the invention.
Figure 3A:
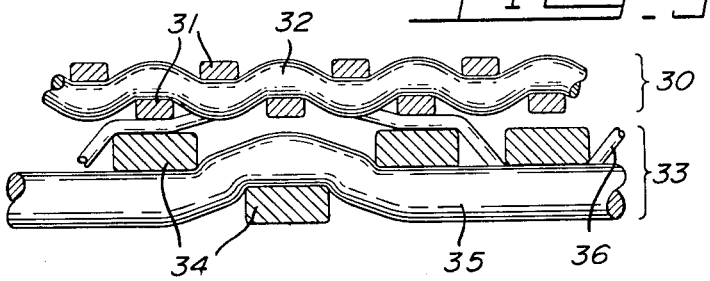

FIGS. 3, 3A and 3B depict another embodiment of the composite fabric of the invention. In this embodiment the upper layer 30 is the same as upper layer 20 of FIG. 2, with the same reduced frame width $x^1$ and length $y^1$. The lower layer 33 is a four-harness satin weave with coarse warps 34 and wefts 35, again with half the mesh count to the upper layer 30, but with the warps 34 having a flattened profile. The two layers are again interconnected in the weft direction by a binder yarn 36.

Although the embodiments illustrated in FIGS. 2 and 3 show a bottom weave with half the mesh count of the upper weave, it is understood that the invention is not limited to composite fabrics having this particular mesh ratio. That is, the mesh ratio of warps and wefts in the upper weave to warps and wefts in the bottom weave may be 3:2, 4:3, 5:4, or any combination, as described in the prior art.

FIG. 4 is a greatly enlarged cross-section of one of the flattened warps showing the flattening aspect ratio, which is defined herein as the strand width "b" divided by the strand height "a".

Increasing the warp flattening aspect ratio, particularly by increasing the strand width "b" at constant strand height "a" enables substantial degrees of reduction in the size of fabric surface openings to be realized.

Higher flattening ratios also enable reductions in fabric thickness to be achieved, particularly if flattened warps are also used in the bottom layer 23 of the composite fabric. For example, when the aforementioned 63 mesh plain weave upper weave with 0.0045"×0.0075" flattened warps was combined with a bottom weave using 0.0075"×0.015" flattened warps (aspect ratio of 2.0) or 0.0073"×0.015" (aspect ratio of 2.05) at a mesh count of 31½ strands per inch, reductions of 0.002"–0.003" in fabric thickness were observed, compared to the same mesh counts woven with round warp strands.

Preferably, the flattening aspect ratio of the monofilament warp yarns in either the top or bottom layer will be 1.20–2.30. More preferably, an aspect ratio of 1.30–2.00 has been found to be desirable for the flattened warps of the upper layer in order to control the machine direction length of surface openings and the dewatering capacity of the fabric. A preferred aspect ratio for the flattened warps of the bottom layer is 1.60–2.20 which enhances reductions in fabric thickness without detrimental effects on the resistance of the cloth to stretching and narrowing.

The use of flattened warps in the upper layer reduces the severity of the "dimples" associated with weft binder yarns, and thus reduces the tendency for wire mark in the paper sheet.

In composite fabrics of the prior art, when round cross-section warps of the upper layer are used as binder yarns the resultant "dimples" in the top surface are deeper and more disruptive to the adjacent mesh than those formed with weft binders. In the composite fabric of the invention, the use of flattened warps makes it practicable to use warp binders, since the mesh distortion and depth of the "dimples". is greatly reduced.

Also, in the case of warp binder yarns, the top layer disruption is reduced even further if smaller diameter bottom weft strands are used in the bottom layer at only those positions where the top layer warp binder actually interweaves the bottom weft layer. This smaller diameter bottom weft may also advantageously be a different material than the regular bottom weft yarns; for example, polyamides such as nylon 6 or nylon 66 may be used instead of polyester.

The invention applies to composite fabrics with an upper fabric layer woven with warp mesh counts of 36–100 strands per inch, which is the normal range for paper machine forming fabrics. More preferably, the warp mesh count of the upper weave will be 40–80 strands per inch. Typical flat warp dimensions for the preferred ranges of aspect ratio and warp mesh count are:

| | Aspect ratio = 1.3 | Aspect ratio = 2.0 |
|---|---|---|
| 40 strands per inch | .010" × .013" | .0081" × .0162" |
| 80 strands per inch | .0047" × .0061" | .0038" × .0076" |

This invention is not limited to the weaves illustrated; that is, the upper fabric layer and the lower fabric layer can be woven in any construction and in any mesh count. Accordingly, it is within the ambit of the present invention to cover any obvious modifications, provided such modifications fall within the scope of the appended claims.

I claim:

1. A composite paper-making forming fabric of reduced thickness and having improved fiber retention, comprising at least two complete weaves, each formed by its own set of warp and weft yarns and being interconnected by binder yarns which are separately interwoven with said two complete weaves, an upper one of said complete weaves constituting a paper-side weave which is comprised of flattened warp yarns having an aspect ratio of width to height of between 1.20 and 2.30 and interwoven with said weft yarns and having a plain weave, and a bottom one of said complete weaves constituting the machine-side weave which is comprised of flattened warp yarns having an aspect ratio of width to height of between 1.20 and 2.30; wherein said bottom weave has a mesh count of substantially half that of said upper weave; and wherein said upper weave has a machine-direction frame length which is less than that when round yarns are used; and further wherein the product of the warp mesh count and the width of the flattened warp strands in the upper weave is not more than about 0.65.

2. The composite forming fabric as claimed in claim 1, in which said binder yarns are woven in the weft direction.

3. The composite forming fabric as claimed in claim 1, in which said binder yarns are woven in the warp direction.

4. The composite fabric as claimed in claim 1, in which said flattened warps of the upper weave have an aspect ratio of width to height of between 1.30 and 2.00.

5. The composite fabric as claimed in claim 1, in which said flattened warps of the upper weave have an aspect ratio of width to height of between 1.67–1.75.

6. The composite fabric as claimed in claim 1, in which said flattened bottom warps have an aspect ratio of width to height of between 1.60–2.20.

7. The composite fabric as claimed in claim 1, in which said flattened bottom warps have an aspect ratio of width to height of between 2.00–2.05.

8. The composite fabric as claimed in claim 1, wherein said upper weave has a warp mesh count of 36–100 strands per inch.

9. The composite fabric as claimed in claim 8, wherein said upper weave has a warp mesh count of about 40–80 strands per inch.

10. The composite fabric as claimed in claim 1, wherein the product of the warp mesh count and the width of the flattened warp strands in the upper weave of said forming fabric is in the range of about 0.47 to 0.65.

* * * * *

UNITED STATES PATENT AND TRADEMARK OFFICE

CERTIFICATE OF CORRECTION

PATENT NO. : 4,815,499

DATED : MARCH 28, 1989

INVENTOR(S) : Dale B. JOHNSON

It is certified that error appears in the above-identified patent and that said Letters Patent is hereby corrected as shown below:

ON TITLE PAGE: after "[22] Filed: Feb. 25, 1988", insert

-- Related U.S. Application Data

[60] Continuation of Ser. No. 06/935,953, Filed: Nov. 28, 1986, abandoned. --

Signed and Sealed this

Seventh Day of July, 1992

*Attest:*

DOUGLAS B. COMER

*Attesting Officer*

*Acting Commissioner of Patents and Trademarks*